US009708838B2

(12) United States Patent
Nagata et al.

(10) Patent No.: US 9,708,838 B2
(45) Date of Patent: Jul. 18, 2017

(54) VEHICLE DOOR HANDLE DEVICE

(71) Applicant: AISIN SEIKI KABUSHIKI KAISHA, Kariya-shi (JP)

(72) Inventors: Koichi Nagata, Chiryu (JP); Mizuya Sakamoto, Kariya (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 370 days.

(21) Appl. No.: 14/388,335

(22) PCT Filed: Mar. 25, 2013

(86) PCT No.: PCT/JP2013/058527
§ 371 (c)(1),
(2) Date: Sep. 26, 2014

(87) PCT Pub. No.: WO2013/146653
PCT Pub. Date: Oct. 3, 2013

(65) Prior Publication Data

US 2015/0048633 A1 Feb. 19, 2015

(30) Foreign Application Priority Data

Mar. 28, 2012 (JP) ..... 2012-073542

(51) Int. Cl.
*E05B 3/00* (2006.01)
*E05B 85/16* (2014.01)
(Continued)

(52) U.S. Cl.
CPC ..... *E05B 85/16* (2013.01); *E05B 79/08* (2013.01); *E05B 17/0012* (2013.01);
(Continued)

(58) Field of Classification Search
CPC ..... E05B 85/10; E05B 85/14; E05B 85/16
(Continued)

(56) References Cited

U.S. PATENT DOCUMENTS 6,152,501 A * 11/2000 Magi ..... E05B 5/00 292/169
6,167,779 B1 * 1/2001 Sano ..... E05B 85/12 292/336.3

(Continued)

FOREIGN PATENT DOCUMENTS

JP 09-123805 A 5/1997
JP 2001-323689 A 11/2001

(Continued)

OTHER PUBLICATIONS

International Search Report (PCT/ISA/210) mailed on May 21, 2013, by the Japanese Patent Office as the International Searching Authority for International Application No. PCT/JP2013/058527.

(Continued)

*Primary Examiner* — Carlos Lugo
(74) *Attorney, Agent, or Firm* — Buchanan Ingersoll & Rooney PC

(57) ABSTRACT

A vehicle door handle device, including: a frame fixable on a vehicle door panel inner side, the frame having a supporting hole; a link including a shaft section pivotably supported in the supporting hole, the link being configured to be rotated and biased by a biasing member to one side; and an outer handle mountable on the door panel, the outer handle including an engaging portion to be engaged on the link, the outer handle being configured to pivot the link through the engaging portion against a rotational biasing force of the biasing member. The shaft section includes: a groove portion and a guide portion in the shaft section to extend in an extending direction of the groove portion. The frame includes a groove engaging portion insertable through the groove portion, and an opening to enable the guide portion to be inserted through the opening.

6 Claims, 8 Drawing Sheets

(51) Int. Cl.

| | |
|---|---|
| ***E05B 79/08*** | (2014.01) |
| *E05B 1/00* | (2006.01) |
| *E05B 85/14* | (2014.01) |
| *E05B 85/10* | (2014.01) |
| *E05B 17/00* | (2006.01) |

(52) U.S. Cl.
CPC ..... *E05B 85/10* (2013.01); *E05B 85/14* (2013.01); *Y10T 292/57* (2015.04)

(58) Field of Classification Search
USPC ..... 292/336.3
See application file for complete search history.

(56) References Cited

U.S. PATENT DOCUMENTS 6,672,633 B2 * 1/2004 Nomura ..... E05B 79/06 292/336.3
6,749,236 B2 * 6/2004 Nomura ..... E05B 85/16 16/412
6,988,752 B2 * 1/2006 Belchine, III ..... E05B 85/12 16/266
8,128,137 B2 * 3/2012 Takaya ..... E05B 85/16 292/336.3
9,500,002 B2 * 11/2016 Bailey ..... E05B 3/02
2002/0008389 A1 1/2002 Nomura et al.
2008/0018120 A1 * 1/2008 Bailey ..... E05B 85/12 292/336.3
2008/0277948 A1 11/2008 Takaya et al.

FOREIGN PATENT DOCUMENTS

JP 2002-285740 A 10/2002
JP 2008-280746 A 11/2008
JP 2010-261217 A 11/2010

OTHER PUBLICATIONS

Written Opinion (PCT/ISA/237) mailed on May 21, 2013, by the Japanese Patent Office as the International Searching Authority for International Application No. PCT/JP2013/058527.

* cited by examiner

VEHICLE DOOR HANDLE DEVICE

TECHNICAL FIELD

The present invention relates to a vehicle door handle device, and more particularly, to a vehicle door handle device including a grip-type outer handle.

BACKGROUND ART

Hitherto, as a vehicle door handle device, a vehicle door handle device described in, for example, Patent Literature 1 has been known. FIG. 9 is a view schematically illustrating mounting structure between a link and a frame that are applied to the related-art vehicle door handle device. FIG. 10 is a perspective view of the link viewed from one side thereof.

As illustrated in FIG. 9, the vehicle door handle device includes a frame 112 fixed on a vehicle inner side (left side of the drawing sheet) of an outer panel 111, a link 114 pivotably assembled to the frame 112 and configured to be rotated and biased by a spring to one side, and an outer handle 115 mounted on the frame 112 from a vehicle outer side (right side of the drawing sheet) of the outer panel 111. As illustrated in FIG. 10, the link 114 includes a shaft portion 114*a* having a guide portion 114*b* formed at each end thereof in a rotation axis direction. As illustrated in FIG. 9, in the frame 112, a slot 112*a* and a supporting hole 112*b* are formed. Into the slot 112*a*, the shaft portion 114*a* of the link 114 can be inserted from the vehicle inner side (left side of the drawing sheet). The supporting hole 112*b* is formed continuously with the slot 112*a*, for pivotably supporting the shaft portion 114*a*. The shaft portion 114*a* including the guide portion 114*b* is inserted through the slot 112*a* into the supporting hole 112*b*, and is pivoted by a predetermined amount. Thus, an outer peripheral surface 114*c* of the shaft portion 114*a* is supported in the supporting hole 112*b*, and thus movement of the shaft portion 114*a* to the vehicle inner side is restricted.

When the outer handle 115 is moved to the vehicle outer side at the time of operation of the outer handle 115, an input portion 114*d* formed on the link 114 and engaged on the outer handle 115 is pressed, and thus the shaft portion 114*a* including the guide portion 114*b* is pivoted in the supporting hole 112*b*. Accordingly, the link 114 is pivoted with respect to the frame 112 with the shaft portion 114*a* as a rotation center.

CITATION LIST

Patent Literature

[PTL 1] JP 2001-323689 A

SUMMARY OF INVENTION

Technical Problems

However, according to the vehicle door handle device described in Patent Literature 1, a gap is present between an inner peripheral surface 112*c* of the supporting hole 112*b* and the guide portion 114*b* of the shaft portion 114*a*, and the guide portion 114*b* is not held in slide-contact with the supporting hole 112*b*. Accordingly, when the link 114 is pivoted with respect to the frame 112 with the shaft portion 114*a* as the rotation center, the shaft portion 114*a* including the guide portion 114*b* may move toward the gap in the supporting hole 112*b*. Thus, backlash easily occurs between the frame 112 and the link 114 assembled to the frame 112, and hence there is a fear in that operability of the door handle may be deteriorated at the time of operation of the outer handle 115.

The present invention has been made in view of the above-mentioned problems, and has an object to prevent backlash of a link assembled to a frame from occurring with respect to the frame, to thereby enhance operability of a door handle.

Solution to Problems

In order to solve the above-mentioned problems, the gist of the present invention resides in a vehicle door handle device, including: a frame configured to be fixed on a vehicle inner side of a door panel of a vehicle door, the frame having a supporting hole formed therein; a link including a shaft section pivotably supported in the supporting hole of the frame, the link being pivotably assembled to the frame through intermediation of the shaft section, and configured to be rotated and biased by a biasing member to one side; and an outer handle configured to be mounted on the door panel, the outer handle including an engaging portion to be engaged on the link, the outer handle being configured to pivot the link through intermediation of the engaging portion against a rotational biasing force of the biasing member, in which the shaft section includes a groove portion recessed in one end portion of the shaft section in a rotation axis direction of the shaft section so as to extend to another end portion side of the shaft section, and a guide portion formed in an outer peripheral surface of the shaft section so as to extend in an extending direction of the groove portion, in which the frame includes a groove engaging portion insertable through the groove portion from a direction different from the rotation axis direction, and an opening formed continuously with the supporting hole so as to enable the guide portion to be inserted through the opening from the direction different from the rotation axis direction, and in which under a state in which the shaft section is supported in the supporting hole, the groove portion and the opening extend in different directions.

According to the above-mentioned configuration, under a state in which the shaft section of the link is pivotably supported in the supporting hole of the frame, the guide portion and the groove portion restrict movement of the shaft section in two directions, that is, a passing direction of the guide portion through the opening and a direction different from the passing direction, and hence the shaft section can be pivoted without moving in the supporting hole. This can prevent occurrence of the backlash between the link and the frame, to thereby enhance the operability of a door handle.

In an embodiment, the shaft section includes a first shaft portion having the groove portion formed therein, and a second shaft portion having the guide portion formed therein, the second shaft portion being formed adjacent to the first shaft portion in the rotation axis direction, and the supporting hole includes a first supporting hole for supporting the first shaft portion, and a second supporting hole for supporting the second shaft portion.

According to the above-mentioned configuration, the guide portion and the groove portion are formed in line along the rotation axis direction of the shaft section, and hence it is possible to ensure a shaft diameter and a peripheral surface of the shaft section. With this configuration, durability of the shaft section can be easily ensured.

In an embodiment, the groove portion of the first shaft portion includes a first wall portion and a second wall portion that are opposed to each other, and under a state in which the link is assembled to the frame, the first wall portion and the second wall portion hold the groove engaging portion between the first wall portion and the second wall portion in a direction different from a direction in which the second shaft portion passes through the opening, to thereby restrict movement of the first shaft portion in the direction different from the direction in which the second shaft portion passes through the opening.

According to the above-mentioned configuration, the first shaft portion holds the groove engaging portion between the first wall portion and the second wall portion of the groove portion, to thereby restrict the movement of the first shaft portion in the direction different from the direction in which the second shaft portion passes through the opening. With this configuration, the groove portion of the first shaft portion can be more firmly engaged on the groove engaging portion.

In an embodiment, the first wall portion and the second wall portion are formed in the groove portion so as to allow the groove engaging portion to pass through the groove portion in the same direction as the direction in which the second shaft portion passes through the opening.

According to the above-mentioned configuration, a direction in which the groove engaging portion passes through the groove portion of the first shaft portion is the same as the direction in which the second shaft portion passes through the opening. With this configuration, the shaft section including the first shaft portion and the second shaft portion can be caused to pass through the opening of the frame from one direction, and thus it is possible to facilitate assembly of the link including the shaft section to the frame.

In an embodiment, the groove portion includes a connection portion continuously formed between the first wall portion and the second wall portion so as to connect the first wall portion and the second wall portion to each other.

According to the above-mentioned configuration, in the groove portion, the first wall portion and the second wall portion are connected together by the connection portion. With this configuration, the first wall portion and the second wall portion of the groove portion can be reinforced, and thus can more stably support the groove engaging portion.

Advantageous Effects of Invention

As described in detail above, it is possible to prevent the backlash of the link assembled to the frame from occurring with respect to the frame, to thereby enhance the operability of the door handle.

DESCRIPTION OF EMBODIMENT

Figure 1:
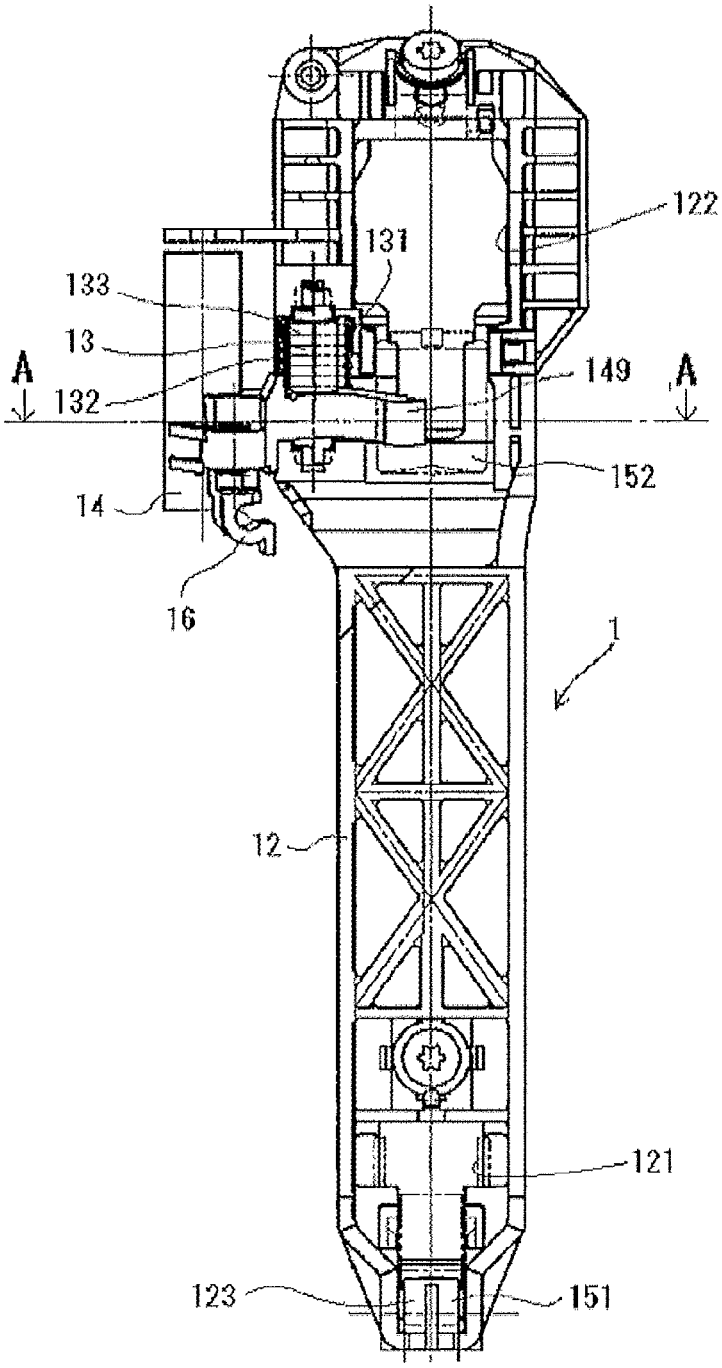
FIG. 1 is a side view of a vehicle door handle device according to an embodiment of the present invention viewed from a vehicle inner side.

Now, an embodiment of the present invention is described with reference to the drawings. A vehicle door handle device 1 according to the present invention illustrated in FIGS. 1 and 2 includes a frame 12 fixed on a vehicle inner side of an outer panel 11 (door panel) of a vehicle door 100, a link 14 pivotably assembled to the frame 12 and configured to be rotated and biased by a spring 13 (biasing member) to one side, and an outer handle 15 to be operated so as to open and close the vehicle door 100 and mounted on a vehicle outer side of the outer panel 11.

The frame 12 has an insertion hole 121 and an insertion hole 122 formed therein. An engaging portion 151 formed on one end of the outer handle 15 can be inserted into the insertion hole 121. An insertion protrusion 152 formed on another end of the outer handle 15 can be inserted into the insertion hole 122. A supporting portion 123 is formed on the frame 12 in proximity to the insertion hole 121. The engaging portion 151 of the outer handle 15 is supported by the supporting portion 123 so as to be capable of tilting. Note that, insertion holes (not shown) are formed also in the outer panel 11 so as to correspond to the insertion holes 121, 122.

Figure 5:
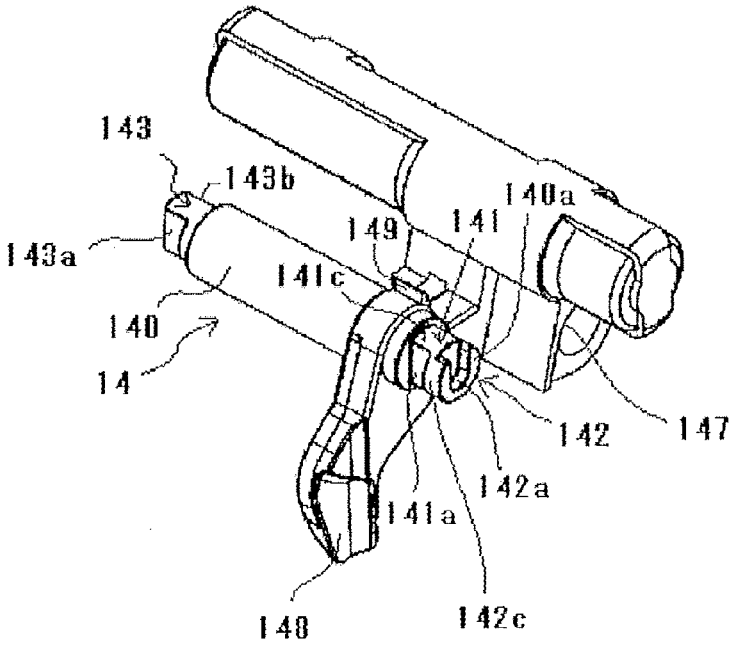
FIG. 5 is a perspective view of a link viewed from one side thereof.

The link 14 is pivotably supported on the frame 12 through intermediation of a shaft section 140 formed on the link 14. As illustrated in FIG. 5, the shaft section 140 of the link 14 includes a first shaft portion 142 having an outer peripheral surface 142*c* with a substantially circular cross-section perpendicular to a rotation axis direction and formed on an end portion 140*a* (one end portion), a shaft portion 143 formed on another end portion, and a second shaft portion 141 formed adjacent to the first shaft portion 142 along the rotation axis direction at a position on the shaft portion 143 side with respect to the first shaft portion 142 and having an outer peripheral surface 141*c* with a substantially circular cross-section perpendicular to the rotation axis direction. The second shaft portion 141, the first shaft portion 142, and the shaft portion 143 are formed on a rotation axis of the shaft section 140.

Figure 6:
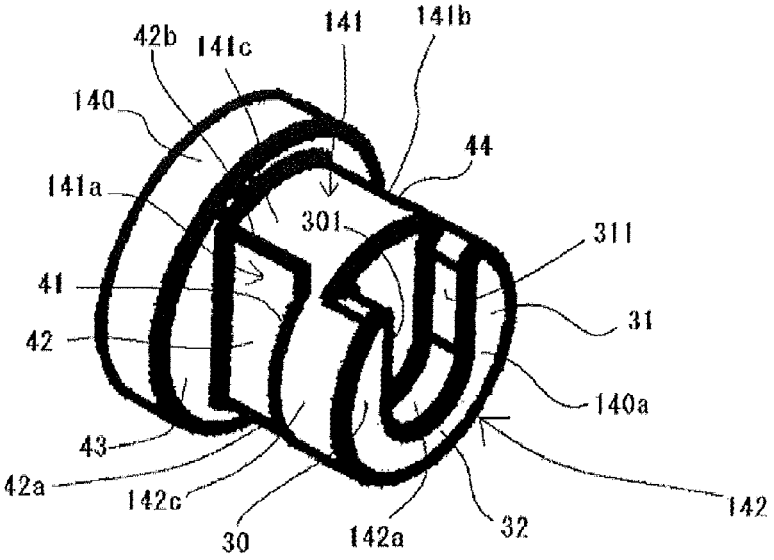
FIG. 6 is an enlarged view of a shaft section of the link including a groove portion formed therein.

Further, as illustrated in FIG. 6, a pair of guide portions 141*a*, 141*b* is formed in the outer peripheral surface 141*c* of the second shaft portion 141. The guide portions 141*a*, 141*b* are formed by cutting out a part of the outer peripheral surface 141*c* so as to form flat guide surfaces 42, 44. The guide portions 141*a*, 141*b* are shaped so as to form recessed portions with a rear end portion 41 of the first shaft portion 142, the guide surfaces 42, 44, and an end portion 43 of the shaft section 140. Note that, the guide surface 42 of the guide portion 141*a* and the guide surface 44 of the guide portion 141*b* are each formed of one surface, but shapes of the guide surfaces 42, 44 are not limited thereto. For example, a chamfer such as a curved surface or a flat surface may be formed in at least one of or both of end portions 42*a*, 42*b* of the guide surface 42, and thus each of the guide surfaces 42, 44 may be formed of a plurality of surfaces.

Further, a groove portion 142*a* is formed in the first shaft portion 142. The groove portion 142*a* is recessed from the end portion 140*a* toward the shaft section 140 side, and is opened radially outward. The groove portion 142*a* includes a first wall portion 30 and a second wall portion 31 that are opposed to each other in a radial direction of the first shaft portion 142, and a connection portion 32 formed continuously with the first wall portion 30 and the second wall portion 31 so as to connect the first wall portion 30 and the second wall portion 31 together. The groove portion 142*a* is formed so as to extend in an extending direction of the guide portions 141*a*, 141*b*. The extending direction of the guide portions 141*a*, 141*b* herein refers to an extending direction of the guide surfaces 42, 44 from the end portion 42*a* side to the end portion 42*b* side of the guide surface 42 (end portions of the guide surface 44 are not shown). That is, the first wall portion 30 and the second wall portion 31 forming the groove portion 142*a* extend in the extending direction of the guide surfaces 42, 44. The groove portion 142*a* is formed into such a shape that an inner side surface 301 of the first wall portion 30 is substantially parallel to the guide surface 42 of the guide portion 141*a* and that an inner side surface 311 of the second wall portion 31 is substantially parallel to the guide surface 44 of the guide portion 141*b*.

Figure 2:
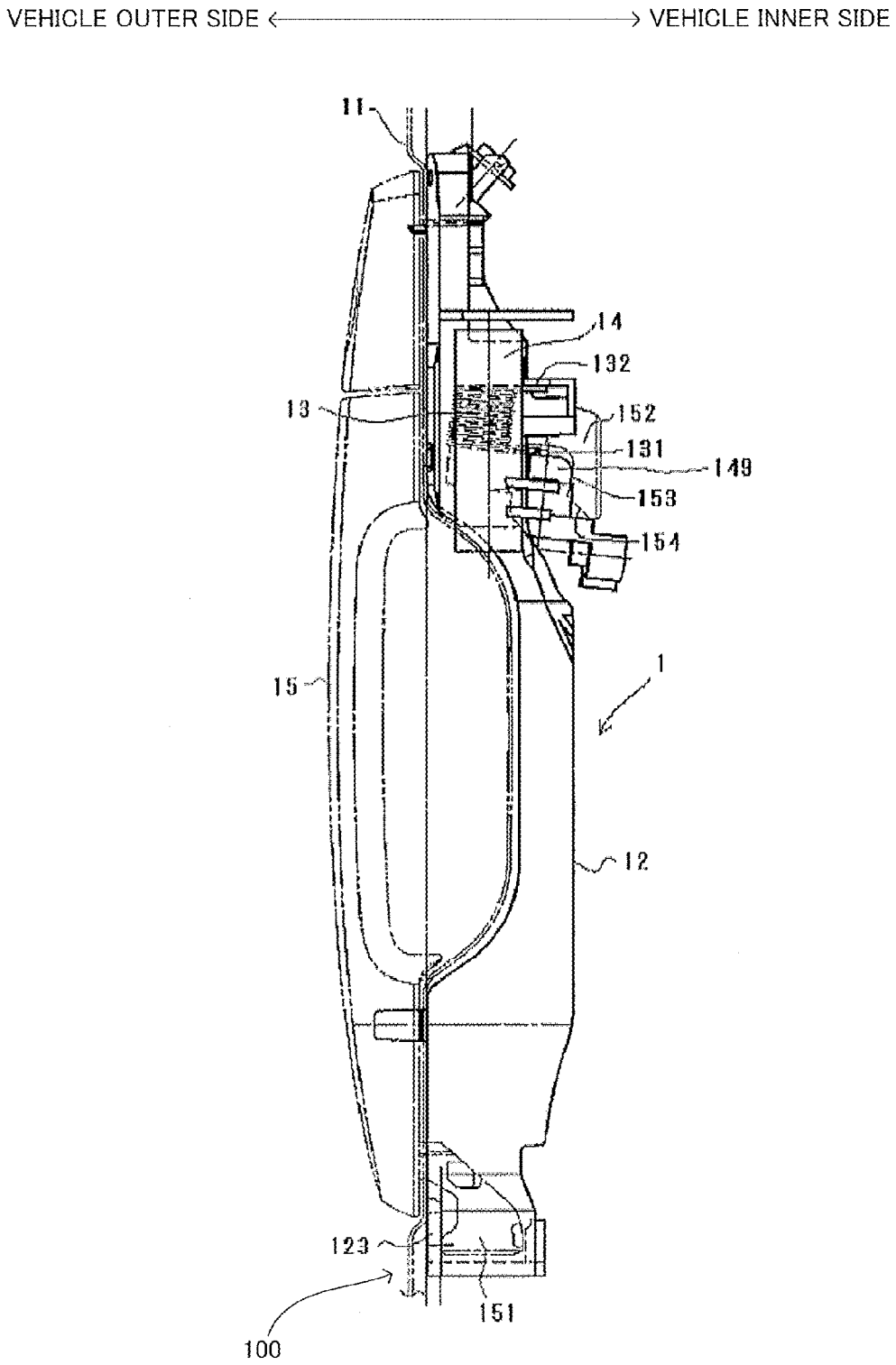
FIG. 2 is a plan view of the vehicle door handle device illustrated in FIG. 1.
Figure 3:
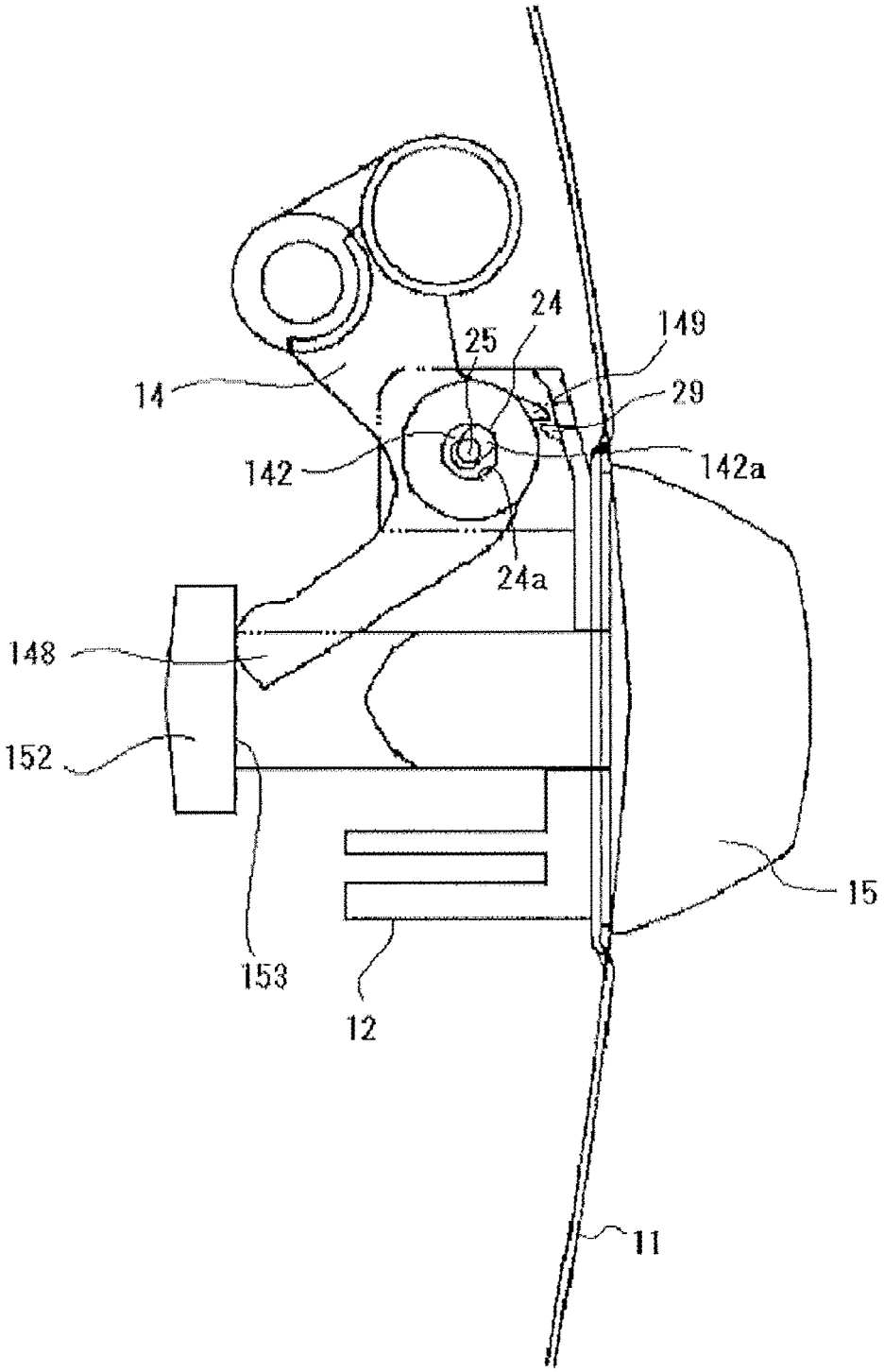
FIG. 3 is a cross-sectional view of the vehicle door handle device taken along the line A-A of FIG. 1.

Further, the shaft section 140 of the link 14 retains a cylindrical portion 133 of the spring 13 (see FIGS. 1 and 2). Moreover, as illustrated in FIG. 3, the link 14 includes an input portion 148 that is engaged in an engaging recessed portion 153 (engaging portion) formed in the insertion protrusion 152 of the outer handle 15, an engaging claw 149 protruding radially outward with respect to a center of the shaft section 140, and a mounting hole 147 for mounting a clip 16 (see FIG. 1). The link 14 is sometimes called a bell crank.

Figure 4:
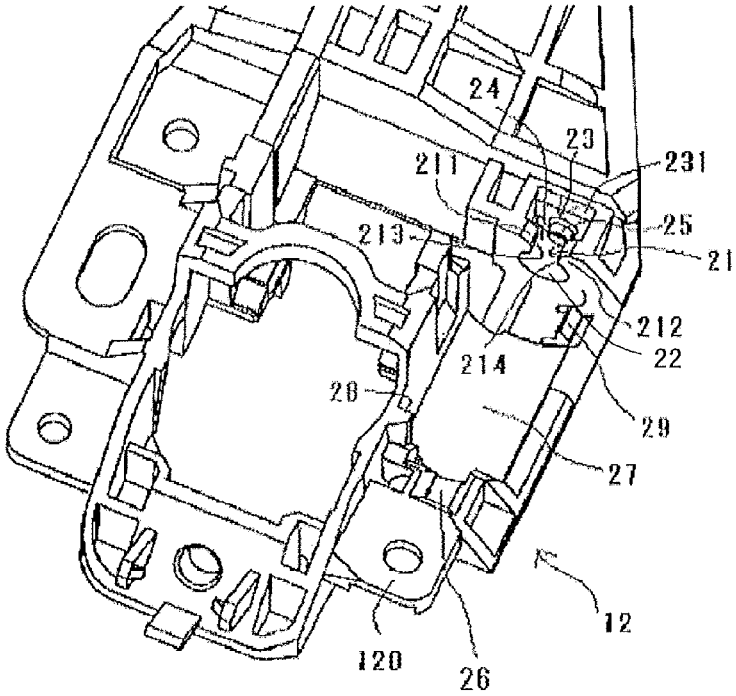
FIG. 4 is a perspective view illustrating an opening and a supporting hole of a frame.

As illustrated in FIG. 4, in the frame 12 to which the link 14 is assembled, a second slot 21 (opening) having a smaller width and a first slot 23 having a larger width are formed so as to be continuous with each other. Further, in the frame 12, a second supporting hole 22 (supporting hole) and a first supporting hole 24 are coaxially formed so as to be continuous with each other to the vehicle outer side of each slot (to a back side of the drawing sheet). The second supporting hole 22 pivotably supports the second shaft portion 141 (see FIG. 5), and the first supporting hole 24 pivotably supports the first shaft portion 142 (see FIG. 5). Further, a locking claw 29, a spring receiving portion 27, and a locking groove 28 for locking a right end 131 of the spring 13 (see FIG. 1) are formed in the frame 12.

Figure 7:
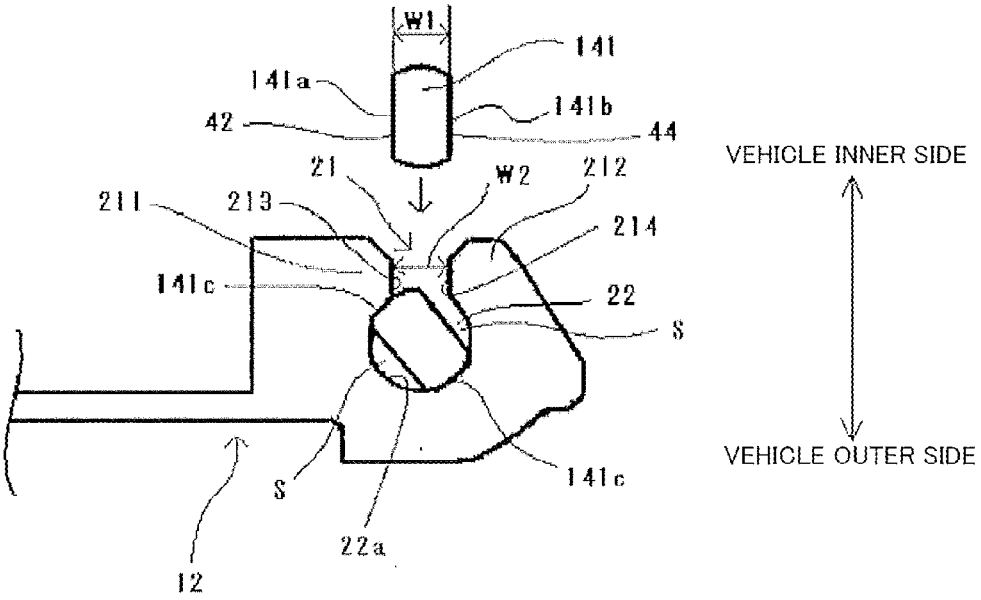
FIG. 7 is an explanatory view schematically illustrating structure in which the shaft section including the groove portion is assembled into the supporting hole.

As illustrated in FIG. 4, the second slot 21 having a smaller width is formed by a first wall portion 211 and a second wall portion 212. An inner side surface 213 of the first wall portion 211 and an inner side surface 214 of the second wall portion 212 are opposed to each other and protrude in mutually approaching directions. Further, as illustrated in FIG. 7, under a state in which a width W1 extending from the guide portion 141*a* to the guide portion 141*b* of the link 14 is matched with a width W2 of the second slot 21, the second shaft portion 141 can be inserted through the second slot 21 from the vehicle inner side. The width W2 of the second slot 21 is equal to a distance between the inner side surfaces 213, 214. Note that, the description: "match" herein encompasses a slight difference in width as well as complete matching, and allows that the width W2 of the second slot 21 is slightly larger than the width W1 between the guide portions 141*a*, 141*b*.

Further, as illustrated in FIG. 4, the frame 12 includes a supporting portion 26 formed by a slot (not shown) through which the shaft portion 143 can be inserted from the vehicle inner side, and a supporting hole (not shown) formed continuously with the slot so as to pivotably support the shaft portion 143. The slot and the supporting hole of the supporting portion 26 have the same shapes as the second slot 21 and the second supporting hole 22.

Figure 8:
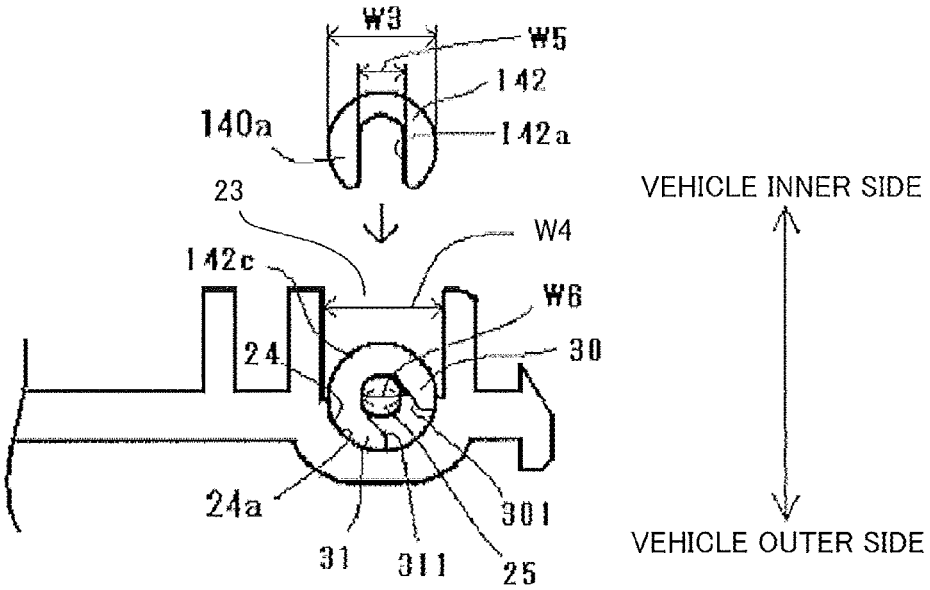
FIG. 8 is an explanatory view schematically illustrating structure in which the shaft section including the groove portion is assembled to a groove engaging portion.
Figure 9:
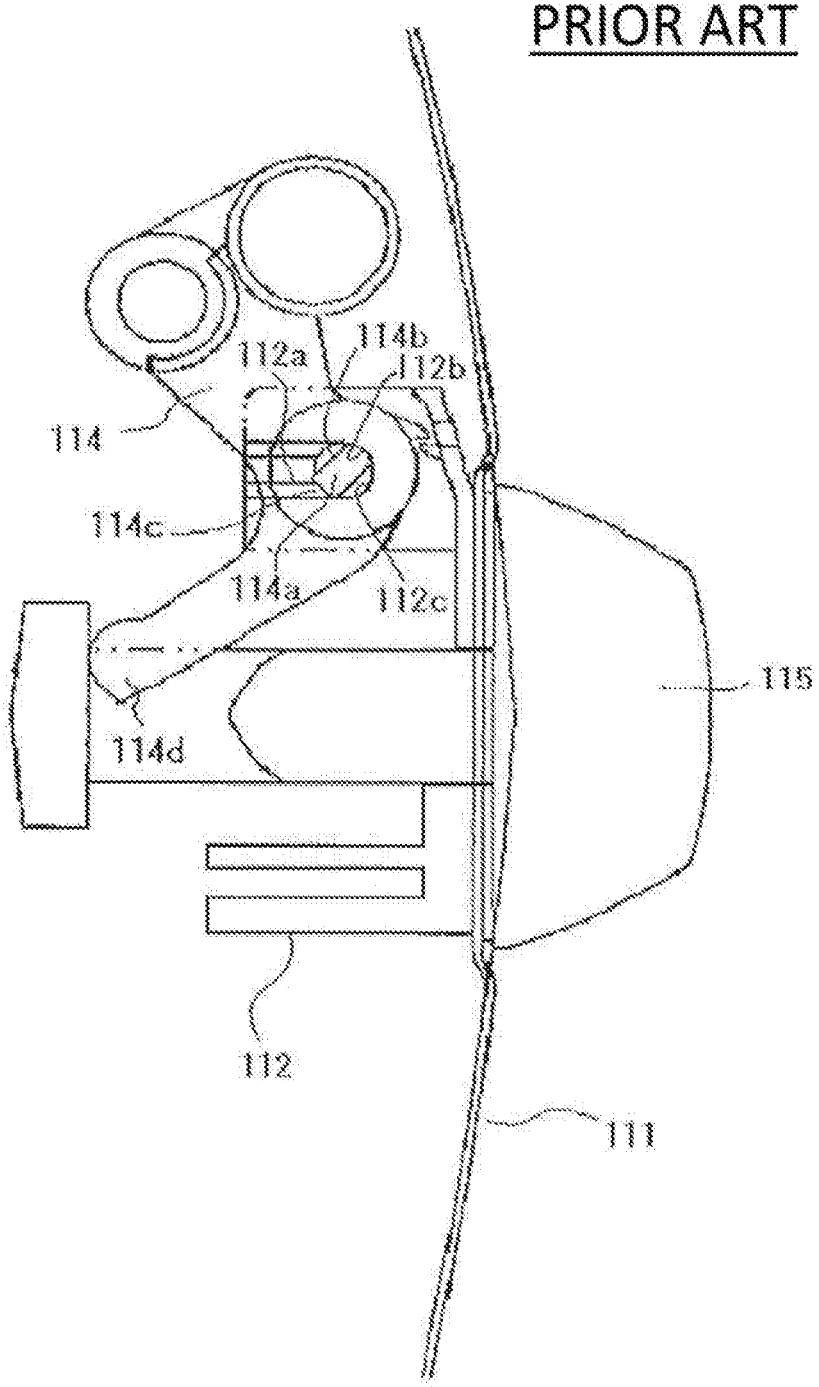
FIG.9 PRIOR ART
FIG. 9 is a view schematically illustrating related-art structure of assembling a link and a frame.
Figure 10:
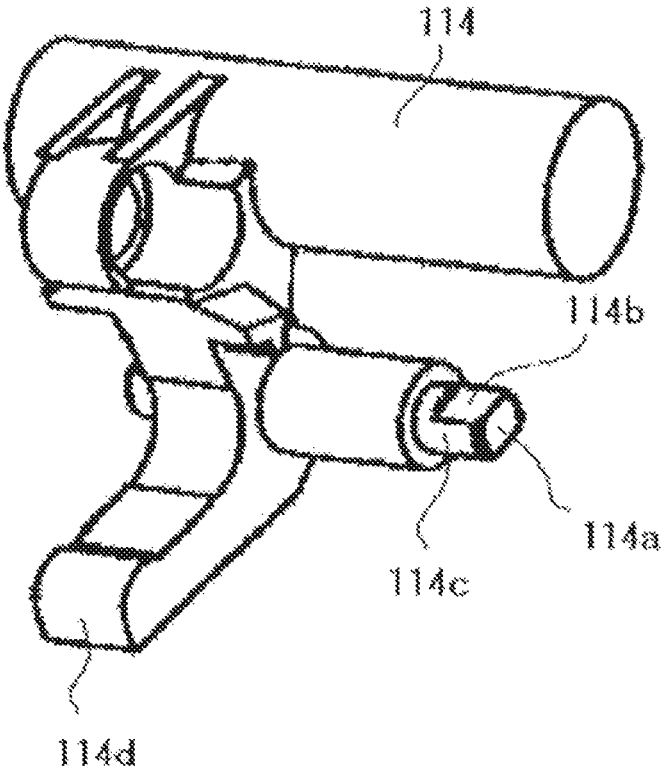
FIG.10 PRIOR ART
FIG. 10 is a perspective view of the related-art link viewed from one side thereof.

As illustrated in FIG. 8, under a state in which an outer diameter W3 of the first shaft portion 142 of the link 14 is matched with a width W4 of the first slot 23, the first shaft portion 142 can be inserted through the first slot 23 from the vehicle inner side. Note that, the description: "match" herein encompasses a slight difference in width as well as complete matching, and allows that the width W4 of the first slot 23 is slightly larger than the outer diameter W3 of the first shaft portion 142. Further, as illustrated in FIGS. 4 and 8, the frame 12 includes a wall portion 231 for forming the first slot 23. The wall portion 231 is formed at a portion that is opposed to the end portion 140*a* of the first shaft portion 142 under a state in which the first shaft portion 142 is inserted into the first slot 23. The wall portion 231 includes a groove engaging portion 25. The groove engaging portion 25 is positioned on the rotation axis of the shaft section 140 pivoting in the first supporting hole 24, and protrudes to the end portion 140*a* side. The groove engaging portion 25 has a substantially columnar shape.

Further, as illustrated in FIG. 3, when the link 14 is pivoted by a predetermined amount against a rotational biasing force of the spring 13 under a state in which insertion of the link 14 into the frame 12 is completed (under a state in which the second shaft portion 141 and the first shaft portion 142 of the link 14 are respectively inserted into the second supporting hole 22 and the first supporting hole 24 of the frame 12 so that the link 14 is pivotable), the locking claw 29 is elastically deformed radially outward by the engaging claw 149 formed on the link 14. The locking claw 29 is restored after elastic deformation, and thus the engaging claw 149 of the link 14 is engaged on the locking claw 29 of the frame 12. In this manner, the link 14 is retained at a temporary retention position.

The spring 13 is formed of a torsion spring for rotating and biasing the link 14 clockwise in FIG. 3. Under a state in which the spring 13 is assembled at a set position between the frame 12 and the link 14 (state illustrated in FIGS. 1 and 2), the spring 13 is engaged at a left end 132 (see FIG. 1) on a locking portion (not shown) of the link 14, engaged at the right end 131 (see FIG. 1) in the locking groove 28 (see FIG. 4) of the frame 12, and assembled at the cylindrical portion 133 to the shaft section 140 of the link 14 with a necessary gap.

As illustrated in FIGS. 1 to 3, the outer handle 15 includes, at one end thereof, the engaging portion 151 (engaging portion) that is engaged on the supporting portion 123 of the frame 12 so as to be capable of tilting. The outer handle 15 includes, at another end thereof, the insertion protrusion 152 having the engaging recessed portion 153 formed therein. The input portion 148 of the link 14 is engaged on the outer handle 15 at the engaging recessed portion 153 of the insertion protrusion 152. As illustrated in FIG. 2, under a state in which the outer handle 15 is assembled to the frame 12, the outer handle 15 can pivot and operate the link 14 against the spring 13. When the link 14 is pivoted and operated, a link rod (not shown) connected to the link 14 through intermediation of the clip 16 is moved, and thus a door locking device (not shown) is unlocked.

Next, a method of assembling the link 14 to the frame 12 is described.

In the vehicle door handle device 1 according to this embodiment, under a state in which the spring 13 is temporarily assembled to the link 14 (under a state in which the cylindrical portion 133 of the spring 13 is fitted to the shaft section 140 of the link 14, and the left end 132 (see FIG. 1) of the spring 13 is engaged on the locking portion (not shown) of the link 14), as illustrated in FIG. 7, a position of each of the guide portions 141*a*, 141*b* of the second shaft portion 141 integrally formed on the link 14 is aligned with a position of the second slot 21 having a smaller width, which is formed in the frame 12, and as illustrated in FIG. 8, a position of the first shaft portion 142 of the link 14 is aligned with a position of the first slot 23 having a larger width, which is formed in the frame 12. Further, as illustrated in FIG. 8, the opening of the groove portion 142*a* of the first shaft portion 142 is directed to the groove engaging portion 25 formed in the first slot 23. Along a vehicle inward-outward direction that is different from the rotation axis direction of the shaft section 140, the link 14 is inserted from the vehicle inner side of the frame 12 toward the vehicle outer side of each slot. The guide portions 141*a*, 141*b* of the second shaft portion 141 pass through a space between the first wall portion 211 and the second wall portion 212 of the second slot 21, and thus the second shaft portion 141 is inserted into the second supporting hole 22. That is, the first wall portion 211 passes through the recessed portion formed by the rear end portion 41, the guide surface 42, and the end portion 43 forming the guide portion 141*a*, and the second wall portion 212 passes through the recessed portion (not shown) of the guide portion 141*b*. In the first shaft portion 142, the groove engaging portion 25 passes through a space between the first wall portion 30 and the second wall portion 31 forming the groove portion 142*a* (that is, the groove engaging portion 25 is inserted from the opening of the groove portion 142*a* through the groove portion 142*a*), and then is inserted to the connection portion 32 side. In this manner, the first shaft portion 142 is inserted into the first supporting hole 24. At this time, the inner side surface 301 of the first wall portion 30 has a substantially parallel relationship with the guide surface 42 of the guide portion 141*a*, whereas the inner side surface 311 of the second wall portion 31 has a substantially parallel relationship with the guide surface 44 of the guide portion 141*b*. Accordingly, the link 14 can be inserted into and assembled to the frame 12 from one direction. Note that, in a similar way to insert the second shaft portion 141 into the second slot 21 and the supporting hole 22, the shaft portion 143 is also inserted into the supporting portion 26.

As illustrated in FIG. 7, under a state in which insertion of the link 14 into the frame 12 is completed, the outer peripheral surface 141*c* of the second shaft portion 141 including the guide portions 141*a*, 141*b* matches with an inner peripheral surface 22*a* of the second supporting hole 22 of the frame 12. Further, as illustrated in FIG. 8, the outer peripheral surface 142*c* of the first shaft portion 142 including the groove portion 142*a* matches with an inner peripheral surface 24*a* of the first supporting hole 24 of the frame 12. When the right end 131 of the spring 13 is engaged in the locking groove 28 of the frame 12, the link 14 is biased onto the frame 12 counterclockwise.

As illustrated in FIG. 3, when the link 14 is pivoted (pivoted counterclockwise in FIG. 3) against the rotational biasing force of the spring 13 by a predetermined amount or more, the engaging claw 149 of the link 14 elastically deforms the locking claw 29 of the frame 12, and climbs over the locking claw 29. After the engaging claw 149 climbs over the locking claw 29, the locking claw 29 is restored. Therefore, when the link 14 is pivoted (pivoted clockwise in FIG. 3) by the rotational biasing force of the spring 13 after restoration of the locking claw 29, the engaging claw 149 of the link 14 is engaged on the locking claw 29 of the frame 12, and thus the link 14 is retained at the temporary retention position.

As illustrated in FIG. 7, when the link 14 is at the temporary retention position, the second shaft portion 141 including the guide portions 141*a*, 141*b* is pivoted in the second supporting hole 22 by a predetermined amount, and the guide portions 141*a*, 141*b* are not positioned within the width W1 of the second slot 21. The second shaft portion 141 is supported in the second supporting hole 22 in such a manner that the outer peripheral surface 141*c* of the second shaft portion 141 is held in the inner peripheral surface 22*a* of the second supporting hole 22, to thereby restrict movement of the second shaft portion 141 in the vehicle inward-outward direction that corresponds to a direction in which the second shaft portion 141 passes through in the second slot 21.

As illustrated in FIG. 8, when the link 14 is at the temporary retention position, the first shaft portion 142 including the groove portion 142*a* is pivoted in the first supporting hole 24 by a predetermined amount. That is, an extending direction of the groove portion 142*a* is different from an extending direction of the second slot 21. In other words, the first shaft portion 142 is formed in such a manner that the inner side surface 301 of the first wall portion 30 and the inner side surface 311 of the second wall portion 31 are inclined by a predetermined angle with respect to the inner side surface 213 of the first wall portion 211 and the inner side surface 214 of the second wall portion 212. The groove engaging portion 25 of the first slot 23 inserted within a width W5 of the groove portion 142*a* is supported so as to be held between the inner side surface 301 of the first wall portion 30 and the inner side surface 311 of the second wall portion 31 of the groove portion 142*a*. In other words, the groove portion 142*a* restricts movement of the first shaft portion 142 in a direction different from the vehicle inward-outward direction that corresponds to the direction in which the second shaft portion 141 passes through in the second slot 21. That is, the groove portion 142*a* holds the groove engaging portion 25 so as to restrict movement of the second shaft portion 141 into a space S formed between the second shaft portion 141 and the second supporting hole 22 illustrated in FIG. 7.

Movement of the first shaft portion 142 in the vehicle inward-outward direction is restricted.

Next, a motion of the link 14 with respect to the frame 12 is described with reference to FIG. 3.

The outer handle 15 is moved to the vehicle outer side through pulling operation performed at the time of opening operation of the vehicle door 100. Along with movement of the outer handle 15 to the vehicle outer side, the insertion protrusion 152 of the outer handle 15 is also moved to the vehicle outer side. When the insertion protrusion 152 is moved to the vehicle outer side, an external force for moving the input portion 148 to the vehicle outer side is applied to the input portion 148 that is formed on the link 14 and engaged in the engaging recessed portion 153 formed in the insertion protrusion 152. Along with movement of the insertion protrusion 152, against the rotational biasing force of the spring 13 provided on the link 14, the input portion 148 pivots the shaft section 140 counterclockwise from the temporary retention position, and pivots the link 14 counterclockwise with the shaft section 140 as a pivot center. When the opening operation performed through the pulling operation of the outer handle 15 is stopped, the shaft section 140 is pivoted to the temporary retention position by the rotational biasing force of the spring 13. Along with this pivoting of the shaft section 140, the input portion 148 is pivoted clockwise to move the insertion protrusion 152 to the vehicle inner side. The outer handle 15 is returned to an original position along with movement of the insertion protrusion 152.

Therefore, according to this embodiment, the following effects can be obtained.

(1) Under a state in which the shaft section 140 of the link 14 is pivotably supported in the second supporting hole 22 of the frame 12, the guide portions 141*a*, 141*b* and the groove portion 142*a* restrict movement of the shaft section 140 in two directions, that is, a passing direction of the guide portions 141*a*, 141*b* through the second slot 21 and a direction different from the passing direction, and hence the shaft section 140 can be pivoted without moving in the second supporting hole 22. This configuration can prevent occurrence of backlash between the link 14 and the frame 12, to thereby enhance operability of a door handle.

(2) The guide portions 141*a*, 141*b* and the groove portion 142*a* are formed in line along the rotation axis direction of the shaft section 140, and hence it is possible to ensure a shaft diameter and a peripheral surface of the shaft section 140. With this configuration, durability of the shaft section 140 can be easily ensured.

(3) The first shaft portion 142 holds the groove engaging portion 25 between the first wall portion 30 and the second wall portion 31 of the groove portion 142*a*, and thus restricts the movement of the second shaft portion 141 in the direction different from the direction in which the second shaft portion 141 passes through the second slot 21. With this configuration, the groove portion 142*a* of the first shaft portion 142 can be more firmly engaged on the groove engaging portion 25.

(4) A direction in which the groove engaging portion 25 passes through the groove portion 142*a* is the same as the direction in which the second shaft portion 141 passes through the second slot 21. With this configuration, the shaft section 140 including the second shaft portion 141 and the first shaft portion 142 can be caused to pass through the second slot 21 and the first slot 23 of the frame 12 from one direction, and thus it is possible to facilitate assembly of the link 14 including the shaft section 140 to the frame 12.

(5) The first wall portion 30 and the second wall portion 31 are connected together by the connection portion 32. With this configuration, the first wall portion 30 and the second wall portion 31 forming the groove portion 142*a* can be reinforced, and thus can more stably support the groove engaging portion 25.

Note that, the embodiment of the present invention may be modified as follows.

According to the above-mentioned embodiment, the groove portion 142*a* is formed in the first shaft portion 142, and the guide portions 141*a*, 142*b* are formed in the second shaft portion 141. However, the present invention is not limited thereto. For example, the guide portions 141*a*, 142*b* and the groove portion 142*a* may be formed in one shaft. That is, the groove portion 142*a* may be recessed in the end portion 140*a* of the shaft section 140, and each of the guide portions 141*a*, 142*b* may be formed in the outer peripheral surface so as to overlap the groove portion 142*a* in a radial direction of the shaft section 140 (that is, may be formed at the same axial position as that of the groove portion 142*a*).

According to the above-mentioned embodiment, the groove portion 142*a* is formed by the first wall portion 30, the second wall portion 31, and the connection portion 32, but the present invention is not limited thereto. For example, the connection portion 32 may be omitted. That is, the inner side surface 301 of the first wall portion 30 and the inner side surface 311 of the second wall portion 31 may be parallel to each other over a radial direction of the first shaft portion 142, and the first wall portion 30 and the second wall portion 31 may form the groove portion 142*a*.

According to the above-mentioned embodiment, the second slots 21, the first slot 23 are formed so as to enable the second shaft portion 141 and the first shaft portion 142 to be inserted therethrough in the vehicle inward-outward direction, but the present invention is not limited thereto. For example, the second slots 21, the first slot 23 may be formed so as to enable the second shaft portion 141 and the first shaft portion 142 to be inserted therethrough in a direction extending along the outer panel under a state in which the frame 12 is fixed to the outer panel 11.

According to the above-mentioned embodiment, the supporting hole for supporting the shaft portion 143 is formed on an end portion 120 side of the frame, and the second supporting hole 22 and the first supporting hole 24 for respectively supporting the second shaft portion 141 and the first shaft portion 142 are formed on a side distant from the end portion 120 of the frame. However, the present invention is not limited thereto. For example, the second supporting hole 22 and the first supporting hole 24 for respectively supporting the second shaft portion 141 and the first shaft portion 142 may be formed on the end portion 120 side of the frame, and the supporting hole for supporting the shaft portion 143 may be formed on the side distant from the end portion 120 of the frame.

The invention claimed is:

1. A vehicle door handle device, comprising:

a frame configured to be fixed on a vehicle inner side of a door panel of a vehicle door, the frame having a supporting hole and a supporting portion formed therein;

a link comprising a shaft section pivotably supported between the supporting hole and the supporting portion of the frame, the link being pivotably assembled to the frame through intermediation of the shaft section, and configured to be rotated and biased by a biasing member to one side; and an outer handle configured to be mounted on the door panel, the outer handle comprising an engaging portion to be engaged on the link, the outer handle being configured to pivot the link through intermediation of the engaging portion against a rotational biasing force of the biasing member, wherein the shaft section comprises:

a groove portion recessed in one end portion of the shaft section in a rotation axis direction of the shaft section so as to extend to another end portion side of the shaft section from a closed end side of the groove portion in a direction transverse to the rotation axis of the shaft section to an open end side of the groove portion; and a pair of guide portions formed in an outer peripheral surface of the shaft section so as to extend in an extending direction of the groove portion, the frame comprises:

a groove engaging portion insertable through the groove portion from a direction different from the rotation axis direction; and an opening formed continuously with the supporting hole so as to enable the pair of guide portions to be inserted through the opening from the direction different from the rotation axis direction, and wherein under a state in which the shaft section is supported in the supporting hole, the groove portion and the opening extend in different directions.

2. A vehicle door handle device according to claim 1, wherein the shaft section comprises a first shaft portion having the groove portion formed therein, and a second shaft portion having the pair of guide portions formed therein, the second shaft portion being formed adjacent to the first shaft portion in the rotation axis direction, and wherein the supporting hole comprises a first supporting hole for supporting the first shaft portion, and a second supporting hole for supporting the second shaft portion.

3. A vehicle door handle device according to claim 2, wherein the groove portion of the first shaft portion comprises a first wall portion and a second wall portion that are opposed to each other, and wherein under a state in which the link is assembled to the frame, the first wall portion and the second wall portion hold the groove engaging portion between the first wall portion and the second wall portion in a direction different from a direction in which the second shaft portion passes through the opening, to thereby restrict movement of the first shaft portion in the direction different from the direction in which the second shaft portion passes through the opening.

4. A vehicle door handle device according to claim 3, wherein the first wall portion and the second wall portion are formed in the groove portion so as to allow the groove engaging portion to pass through the groove portion in the same direction as the direction in which the second shaft portion passes through the opening.

5. A vehicle door handle device according to claim 3, wherein the groove portion comprises a connection portion continuously formed between the first wall portion and the second wall portion so as to connect the first wall portion and the second wall portion to each other.

6. A vehicle door handle device according to claim 1, further comprising:

a locking claw formed on the frame, and configured to restrict rotation of the link by a biasing force of the biasing member through locking on the link when the outer handle is out of operation, to thereby retain the link at a temporary retention position under a state in which the extending direction of the groove portion is different from a direction in which the shaft section is inserted into the supporting hole.

* * * * *